United States Patent [19]

Lindemann

[11] 4,049,862

[45] Sept. 20, 1977

[54] FOAMED PIGMENTED EMULSIONS FOR THE BACKCOATING OF LOOSELY STRUCTURED FABRICS

[75] Inventor: Martin K. Lindemann, Greenville, S.C.

[73] Assignee: Chas. S. Tanner Co., Greenville, S.C.

[21] Appl. No.: 720,839

[22] Filed: Sept. 9, 1976

[51] Int. Cl.[2] ..... B32B 7/00

[52] U.S. Cl. ..... 428/253; 260/2.5 L; 260/2.5 N; 428/265; 428/267; 428/310

[58] Field of Search ..... 428/245, 253, 254, 255, 428/265, 267, 287, 310, 314, 320; 260/2.5 N, 2.5 L

[56] References Cited

U.S. PATENT DOCUMENTS

| | | | |
|---|---|---|---|
| 3,748,217 | 7/1973 | May et al. | 428/286 |
| 3,823,104 | 7/1974 | Bondy et al. | 260/2.5 L |

*Primary Examiner*—James J. Bell

*Attorney, Agent, or Firm*—Dressler, Goldsmith, Clement, Gordon & Shore, Ltd.

[57] ABSTRACT

A foamed pigmented thermosetting aqueous emulsion useful for the backcoating of loosely structured fabrics, especially those made of polypropylene fibers, is provided based on the following components:

1. an aqueous emulsion copolymer of 5% to 40% ethylene, from 1% to 10% of reactive monoethylenic monomer comprising monoethylenic monomer carrying the

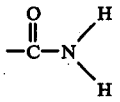

group, such as acrylamide, and the balance consisting essentially of vinyl ester of saturated monocarboxylic acid, such as vinyl acetate;
2. mineral filler providing a pigment to binder ratio of at least 0.5:1, the filler having an alkaline character; and
3. surfactant for stabilizing the emulsion.

10 Claims, No Drawings

FOAMED PIGMENTED EMULSIONS FOR THE BACKCOATING OF LOOSELY STRUCTURED FABRICS

The present invention relates to the backcoating of loosely woven or knitted upholstery fabrics which tend to lose dimensional stability because of the surface lubricity of the fibers constituting the same. This problem is particularly acute when polypropylene fibers are used, but it is also present when other slippery fibers are used, such as nylon, polyester fibers, rayon, or diverse other fibers which have a slippery surface because they are sized with slippery sizes.

As will be apparent, the problem is one of providing low cost fabrics since this is what dictates the looseness of fabric construction.

The objective of this invention is to provide a thermosetting aqueous emulsion binder composition which can be foamed together with large amounts of inexpensive and available fillers, these fillers introducing a problem because of their generally alkaline reaction. Calcium carbonate filler is especially difficult to use and is particularly preferred herein. The filler can also be termed a pigment since it is finely divided and contributes opacity and color to the foam.

In the invention it has been found that thermosetting aqueous emulsion interpolymers cntaining from about 5% to 40% of ethylene, from about 1% to 10% of at least one reactive monoethyleic monomer, as will be discussed, and the balance consisting essentially of vinyl ester with a saturated monocarboxylic acid, particularly vinyl acetate, can be mixed with a large proportion of finely divided mineral filler having an alkaline character and providing a pigment to binder ratio of at least about 0.5:1, preferably at least 0.85:1, to provide a pigmented emulsion which can be foamed and coated on the back of a loosely structured fabric. When the foam coating is dried and cured, a backcoating is formed which imparts the desired dimensional stability.

Referring more particularly to the vinyl ester component of the copolymer, vinyl acetate is preferred, but vinyl propionate and vinyl butyrate will illustrate other appropriate esters.

The aqueous emulsion polymerization of vinyl acetate with ethylene is itself well known and, hence, it is sufficient to merely illustrate it, as is done in the accompanying example.

A small amount, up to about 0.5% of a polyethylenic compound such as butylene glycol diacrylate or divinyl benzene may be included with the other monomers to increase molecular weight during copolymerization, but this is entirely optional. Excessive cross-linking prior to cure is detrimental and must be avoided.

The emulsion is usually thickened to stabilize the foam. The aqueous emulsions are usually thickened to provide a viscosity of at least 500 up to 15,000 centipoises, the preferred viscosity being in the range of from 2000 up to about 5000 centipoises. The viscosity noted asists when the emulsion is whipped with air or other gas to provide a stable foam.

It is also necessary to employ a surfactant (emulsifier) for stability, but the utilization of surfactants for this purpose is wholly conventional. The surfactants may be either anionic or nonionic, or a combination of the two. The nonionic emulsifiers are illustrated by ethylene oxide adducts of long chain hydrocarbon-substituted phenols, such as nonyl phenol, the phenol being adducted to contain from 10–80 moles of ethylene oxide per mol of the phenol, preferably 20–60. Similar ethylene oxide adducts with long chain alcohols, such as dodecanol, are also suitable though less preferred. Anionic surfactants are illustrated by sodium lauryl sulfate, which may be used alone or together with the nonionics noted. Further foam stabilizers, may be added after copolymerization has been completed.

Foaming is preferably carried out by whipping air into the emulsion with the aid of surfactant to provide a foam having and increased volume of about 0.5 to 4 times the original volume of the emulsion. Preferably, the foam contains about 1 to 2 parts of whipped gas (usually air) by volume per part of emulsion.

The preferred pigmented dispersions contain finely divided calcium carbonate in an amount providing a pigment to binder ratio of from about 0.9:1 to about 2:1. The acrylic binders now in use do not function well when the calcium carbonate to binder ratio exceeds about 0.6:1 so that desired hand is lost. When vinyl acetate-butyl acrylate copolymer emulsions are used, the calcium carbonate to binder ratio should not exceed 0.8:1 for the same reason. Styrene-butadiene copolymer emulsions can accept large amounts of calcium carbonate filler, but these copolymers are not light stable or stable in household environments (because of gas fading) so these copolymers do not provide a desirable alternative.

In this invention, the ethylene-vinyl acetate emulsion copolymer preferably relies upon a reactive monomer which provides the

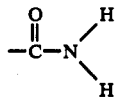

group, especially acrylamide, to provide the curing capacity, and this is especially important when calcium carbonate is the filler. This is bacause calcium carbonate is alkaline and disturbs the simple N-methylol cure whereas acrylamide, either alone or together with hydroxy or N-methyol functionality provides a superior cure in the presence of the alkaline-reacting mineral filler.

Acrylamide can be replaced by other monoethylenically unsaturated reactive monomers providing the same

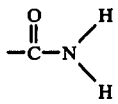

reactive group, appropriate monomers being illustrated by methacrylamide and allyl or methallyl carbamates.

The optional hydroxy functionality can be provided by 2-hydroxy ethyl acrylate or methacrylate, corresponding hydroxy propyl or hydroxy butyl monomers, and also by allyl alcohol. It is not necessary to have the hydroxy functionality present within the emulsion copolymer, so polyvinyl alcohol or similar hydroxy functional protective colloid may be used so long as it is sufficiently associated with the copolymer as is obtained by having it present during the emulsion copolymerization which yields a certain amount of grafting.

The optional N-methylol functionality can be provided by N-methylol allyl carbamate or N-methylol acrylamide or like monoethylenic monomer providing the

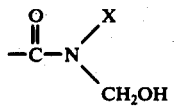

group where X is hydrogen or $-CH_2OH$. The usual N-methylol derivatives contain a single N-methylol group, but more than one such group per molecule is permitted.

Monoethylenic acids such as acrylic acid, methacrylic acid, crotonic acid, itaconic acid, vinyl sulfonic acid, styrene sulfonic acid, or vinyl phosphonic acid may be used in small amount (0.1 to 3% by weight) to provide emulsion stability and to improve adhesion.

Application to the fabric is conveniently carried out by knife coating. Usually, only enough foam is applied to bind the fibers of the fabric together to provide emulsion stability, and this is less than needed to provide a continuous foam layer. More particularly, backcoating practice in accordance with this invention usually involves the application of from about 1.5 to about 5 ounces of added weight per square yard of fabric. In preferred practice, from 2.5 to 4 ounces of foam per square yard of fabric are applied.

From the standpoint of cure, the coated fabric is passed through a baking oven and baking is normally carried out at temperatures of from 220° F. – 500° F. for periods of from 30 seconds to 1 hour, but more usually at 240° F. – 275° F. for from 2–20 minutes.

The invention is illustrated in the examples which follow.

EXAMPLE 1

Production of emulsion copolymer containing ethylene, vinyl acetate, acrylamide, and N-methylol allyl carbamate.

A polymerization pressure reactor equipped with agitator and appropriate pumps for charging materials under pressure is charged with the following before the kettle is pressurized.

| Grams | Component |
|---|---|
| 13,500 | water |
| 68 | sodium persulfate |
| 239 | ethylene oxide nonyl phenol adduct (9 mols of ethylene oxide per mol of phenol - see note 1) |
| 340 | ethylene oxide nonyl phenol adduct (40 mols of ethylene oxide per mol of phenol - see note 2) |
| 1 | ferrous sulfate |

note 1 - Tergitol TP 9 of Union Carbide Corporation may be used.
note 2 - Tergitol PM 3477 of Union Carbide Corporation may be used.

In a separate vessel, the following monomer emulsion is prepared.

| Grams | Component |
|---|---|
| 15,400 | vinyl acetate |
| 3,255 | 16.9% acrylamide solution in water |
| 3,255 | 16.9% N-methylol allyl carbamate solution in water |
| 430 | Adduct of note 1 |
| 610 | Adduct of note 2 |

note 1 - Tergitol TP 9 of Union Carbide Corporation may be used.
note 2 - Tergitol PM 3477 of Union Carbide Corporation may be used.

The precharged kettle which is under constant agitation has added thereto 2340 grams of the above monomer emulsion, and the kettle is sealed and pressurized with ethylene to 1000 p.s.i. gauge and heat is applied to raise the temperature to about 40° C. The pressure elevates to about 1400 p.s.i. when polymerization commences, but it subsides as the ethylene is consumed. Catalyst and activator are added to stimulate polymerization as the reaction proceeds. Ethylene is continuously added to maintain the pressure of 1000 p.s.i.

The activator solution consists of:

| Grams | Component |
|---|---|
| 240 | sodium formaldehyde sulfoxylate |
| 1,760 | water |
| | The catalyst solution consists of: |
| 200 | sodium persulfate |
| 1,800 | water |

These solutions are added together as needed to maintain a temperature of about 50° C.

The balance of the monomer emulsion is added incrementally after polymerization is initiated over a period of 5 hours.

The polymerization was continued for 1 hours after monomer addition is completed to minimize unreacted vinyl acetate.

After 4 hours of monomer addition, acrylamide and N-methylol acrylamide (50:50 mixture) are added as a 16.9% water solution in a total of 900 grams together with 31,00 grams of water. Addition is slow and continues for two hours (until the reaction is over).

The polymerization was maintained at pH 2.5–3.0 by the ammonia provided in the activator solution. The persulfate and sulfoxylate generate sulfuric acid which creates the noted acidity.

When free vinyl acetate is reduced to 0.2%, the kettle is vented and 150 cc of 28% $NH_4OH$ in water are added to neutralize the emulsion and provide pH of 4.6.

| | |
|---|---|
| Particle size | .23 micron |
| Viscosity | 420 centipoise (measured with a Brookfield viscometer using a #2 spindle at 20 rpm) |
| Total solids | 45.7% |
| Tg (Torsional Modulus test, see Applied Polymer Symposia No. 10 (1969) pages 78–82 | −17° C. |
| Insolubles after curing | 86.8% (using perchlorethylene solvent) |
| Intrinsic viscosity | 1.16 (in dimethyl formamide at 30° C.) |

Example 2

Production of Pigmented Emulsion

| Grams | Component |
|---|---|
| 600 | emulsion of Example 1 |
| 58 | water |
| 1.3 | Maleic anhydride - diisobutylene copolymer dispersant - note 3 |
| .2 | tetrasodium polyphosphate dispersant |
| 157 | calcium carbonate (Whiting #10) |
| .2 | Cellosize QP4400 H |
| | Premix the above components other than the emulsion and add the premixture to the emulsion |
| 22 | water |
| 25 | polyacrylic acid thickener (note 4) |
| | premix the water and thickener and add to emulsion |
| 25 | 28% $NH_4OH$ - add to emulsion |

note 3 Tamol 731 (Rohm & Haas)- may be used
note 4 - Acrysol ASE60 (Rohm & Haas) may be used The above provides, on agitation, a pigmented dispersion having a pH of 8.0 and a viscosity of 13,500 centipoises (Brookfield No. 6 Spindle at 20 rpm).

EXAMPLE 3

Foaming and application of pigmented emulsion and testing.

The pigmented dispersion of Example 2 is whipped with air to double the volume. A piece of polypropylene fabric is coated with a 40 mil thick coat of the foamed dispersion and dried and cured in an oven maintained at 260° F. for 7 minutes. The seam slippage is measured by the industry recognized Futurian test and the results are excellent (20.5 psi is the force required to produce seem slippage — the uncoated fabric requires less than 1 psi).

EXAMPLE 4

In Example 2, the pigment to binder ratio is 0.57:1. Repeating example 2 except increasing the calcium carbonate filler to provide a pigment to binder ratio of 1:1 provides substantially the same results, but now the foam coating is more economical since the cost of calcium carbonate solids is much lower than those of the binder solids.

EXAMPLE 5

The N-methylol allyl carbamate used in Example 1 may be prepared as follows:

44 grams of allyl carbamate (0.5 mol) were added to 300 grams of water. The pH was adjsuted to 11.5 with approximately 3 cc of a 50% sodium hydroxide solution, after which 16.5 grams of paraformaldehyde were added. The mixture was heated to 75° C. and kept for 3 hours. An additional 6 cc of a 50% sodium hydroxide solution was added incrementally to maintain the pH at 11. The fomaldehyde content was determined to be 0.4% after 3 hours reaction. The pH was then adjusted to 5 with sulfuric acid to provide the N-methylol derivative.

The invention is defined in the claims which follow.

I claim:

1. A foamed pigmented thermosetting aqueous emulsion comprising an aqueous medium having dispersed therein:

1. an aqueous emulsion copolymer of 5% to 40% ethylene, from 1% to 10% of reactive monoethylenic monomer comprising monoethylenic monomer carrying the

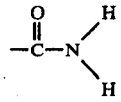

group, and the balance of said copolymer consisting essentially of vinyl ester of saturated monocarboxylic acid;

2. mineral filler providing a pigment to binder ratio of at least 0.5:1, said filler having a alkaline character; and
3. surfactant for stabilizing said emulsion; said aqueous emulsion having a viscosity of from 500 to 15,000 centipoises and being foamed to increase the volume thereof to an extent of from 0.5 to 4 times the original volume.

2. A foamed pigmented emulsion as recited in claim 1 in which said mineral filler is calcium carbonate.

3. A foamed pigmented emulsion as recited in claim 1 in which said pigment to binder ratio is from about 0.9:1 to 2:1.

4. A foamed pigmented emulsion as recited in claim 1 in which said emulsion is foamed to increase the volume thereof to an extent of from 1 to 2 times its original volume.

5. A foamed pigmented emulsion as recited in claim 1 in which said reactive monoethylenic monomer comprises acrylamide alone or together with other monoethylenic monomer providing reactive functionality selected from hydroxy and N-methylol functionality.

6. A foamed pigmented emulsion as recited in claim 5 in which said reactive monoethylenic monomer consists of acrylamide together with monomer providing the N-methylol group and from 0.1 to 3% by weight of monoethylenic acid.

7. A foamed pigmented emulsion as recited in claim 6 in which said monomer providing the N-methylol group comprises N-methylol allyl carbamate.

8. A loosely structured woven or knitted fabric composed of slippery fibers selected from polypropylene, nylon, polyester and rayon fibers, and backcoated with the foamed pigmented emulsion of claim 1.

9. A loosely structured fabric as recited in claim 8 in which said fabric consists of polypropylene fibers.

10. A loosely structured fabric as recited in claim 8 in which said fabric is backcoated with from about 1.5 to about 5 ounces of foam per square yard of fabric.

* * * * *